US005609261A

United States Patent [19]

Hensler

[11] Patent Number: 5,609,261

[45] Date of Patent: Mar. 11, 1997

[54] PIVOTABLE BOOM REST AND LATCH

[75] Inventor: David L. Hensler, Leesburg, Ind.

[73] Assignee: Hydra Tech, Inc., Fort Wayne, Ind.

[21] Appl. No.: 531,180

[22] Filed: Sep. 19, 1995

[51] Int. Cl.[6] ..... F16D 1/00

[52] U.S. Cl. ..... 212/292; 403/328

[58] Field of Search ..... 212/292, 300, 212/349; 403/326, 327, 328, 329, 330

[56] References Cited

U.S. PATENT DOCUMENTS

| | | | |
|---|---|---|---|
| 2,423,583 | 7/1947 | Cooper . | |
| 2,699,314 | 1/1955 | Beale . | |
| 3,545,628 | 12/1970 | Dechantsreiter | 212/292 |
| 3,792,778 | 2/1974 | Sholl et al. | 212/292 |
| 3,921,819 | 11/1975 | Spain | 212/349 |
| 4,184,803 | 1/1980 | Housman . | |
| 4,273,502 | 6/1981 | Maurer . | |
| 4,278,394 | 7/1981 | Johnson . | |
| 4,370,090 | 1/1983 | Shumaker . | |
| 4,636,132 | 1/1987 | Menke . | |
| 4,674,638 | 6/1987 | Oliphant . | |
| 4,978,243 | 12/1990 | Hensler . | |

*Primary Examiner*—Thomas J. Brahan
*Attorney, Agent, or Firm*—Baker & Daniels

[57] ABSTRACT

A boom latch system for a boom movable between use and stowage positions. The boom latch includes a latch member that is operatively connected to the power supply which moves the boom, so that the boom is automatically unlatched when moved from its storage position. The boom latch includes a latch body which pivots to align with the boom latch receiving element, thereby aligning the latch members even under varying load conditions. The latch body also provides a length adjustment so that the latch system can be used with various sizes of booms and hydraulic cylinders.

16 Claims, 3 Drawing Sheets

PIVOTABLE BOOM REST AND LATCH

BACKGROUND OF THE INVENTION

This invention relates to vehicles and other equipment having booms, and in particular to devices for securing such booms to prevent movement thereof during transport of such vehicles.

Vehicles such as cherry pickers, cranes, backhoes and the like usually include a one or two piece boom. Before these vehicles are driven or transported, the boom is usually moved to a stowage position to prevent undue stress on the boom. However, the boom still has a tendency to bounce when the vehicle hits a bump or encounters a turn during transport. This causes significant stress on the joints where the boom is connected to the vehicle and on those portions of the boom which strike other parts of the vehicles. Therefore, it is necessary to secure the boom prior to transport of the vehicle.

Securement of the boom is usually accomplished by providing a boom rest or latch which supports the boom when the boom is moved to its stowage position. Several devices are known for automatically latching a boom.

U. S. Pat. Nos. 2,423,583 and 2,699,314 disclose devices for automatically securing a boom mast on a cargo ship. These devices do not automatically align the boom with the latch and thus require additional operator intervention to provide such alignment.

U.S. Pat Nos. 4,184,803, 4,273,502, 4,278,394, 4,636,132 and 4,370,090 disclose a series of backhoe boom latches requiring manual release of the latch. Additionally, these devices do not support the weight of the boom, which is an important factor in achieving boom stability during transport.

U.S. Pat. No. 4,674,638 discloses a system for dampening boom oscillation during transport by supplying hydraulic pressure to the boom's hydraulic cylinders. However, this system does not latch the boom.

U.S. Pat No. 4,978,243 discloses an automatic boom latch system for an articulated boom movable between use and stowage positions. The boom latch includes a latch member movable between latched and unlatched positions. In the latched position, the latch member engages a latch member receiving means connected to the boom. The latch member is operatively connected to the power supply means which moves the boom, so that the boom may be automatically latched when moved to its stowage position, and automatically unlatched when power is applied to move the boom to a use position. However, varying loads on the boom may cause misalignment and binding between the latch member and the latch member receiving means, thereby hindering the release and/or latching of the mechanism. In addition, larger booms require latches of different lengths due to the increased distance between boom members on larger units, which increased distance is necessitated by the increased size of the hydraulic cylinders of larger booms.

It is thus desired to have a latch that automatically aligns the latch member and the latch member receiving means, and that allows adjustment for use of latch members with various size booms and/or hydraulic cylinders.

OBJECTS OF THE INVENTION

One object of the invention is to provide a boom latch which self aligns, even under varying boom loads.

Another object of the invention is to provide a boom latch which is adjustable for different size booms and/or hydraulic cylinders.

Another object of the invention is to provide a boom latch which is inexpensive and easily constructed.

Still other objects and advantages of the invention will become apparent to those skilled in the art after reading the following description of the invention.

SUMMARY OF THE INVENTION

The invention comprises a boom latch system for a boom movable between use and stowage positions. The boom latch includes a latch member movable between latched and unlatched positions. When in the latched position, the latch member engages a latch member receiving means connected to the boom. The latch body pivots to align the latch member with the latch member receiving means. The latch body is also adjustable for use with variously sized booms.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
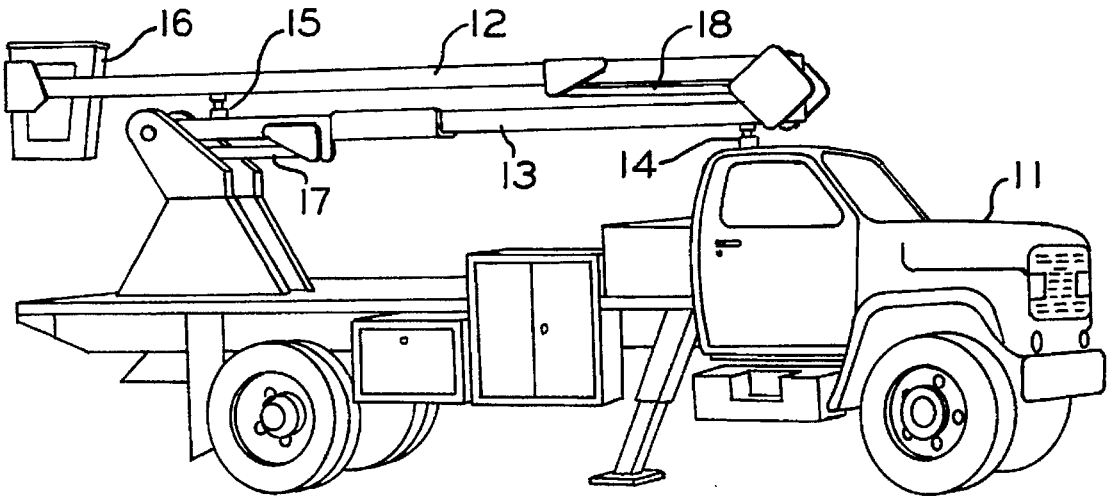
FIG. 1 shows a representative vehicle 11 with an automatic boom latch of the present invention.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates an embodiment of the invention, in one form, and such exemplifications are not to be construed as limiting the scope of the invention in any manner.

DESCRIPTION OF THE PRESENT INVENTION

The embodiment disclosed below is not intended to be exhaustive or limit the invention to the precise form disclosed in the following detailed description. Rather, the embodiment is chosen and described so that others skilled in the art may utilize its teachings.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

FIG. 1 shows a representative vehicle 11 to which an automatic boom latch of the present invention may be applied. Although a cherry picker is shown, it will be appreciated that the latch may be applied to any other vehicle having a movable boom, such as a crane or backhoe. Vehicle 11 has both an upper boom 12 and lower boom 13. In FIG. 1, both booms are in their stowage positions so the vehicle is ready for transport. A first boom latch 14 mounted to the front of the vehicle to latch lower boom 13, and a second boom latch 15 may be mounted on lower boom 13 to latch upper boom 12. It will be appreciated that each boom latch 14 and 15 at least partially supports the weight of the boom. Although vehicle 11 includes two boom latches, a single latch, or more than two latches, may be desirable depending on the particular vehicle and its uses. Booms 12 and 13 are generally moved by hydraulic cylinders 17 and 18, which are actuated by hydraulic controls (not shown) by an operator in bucket 16.

Figure 2:
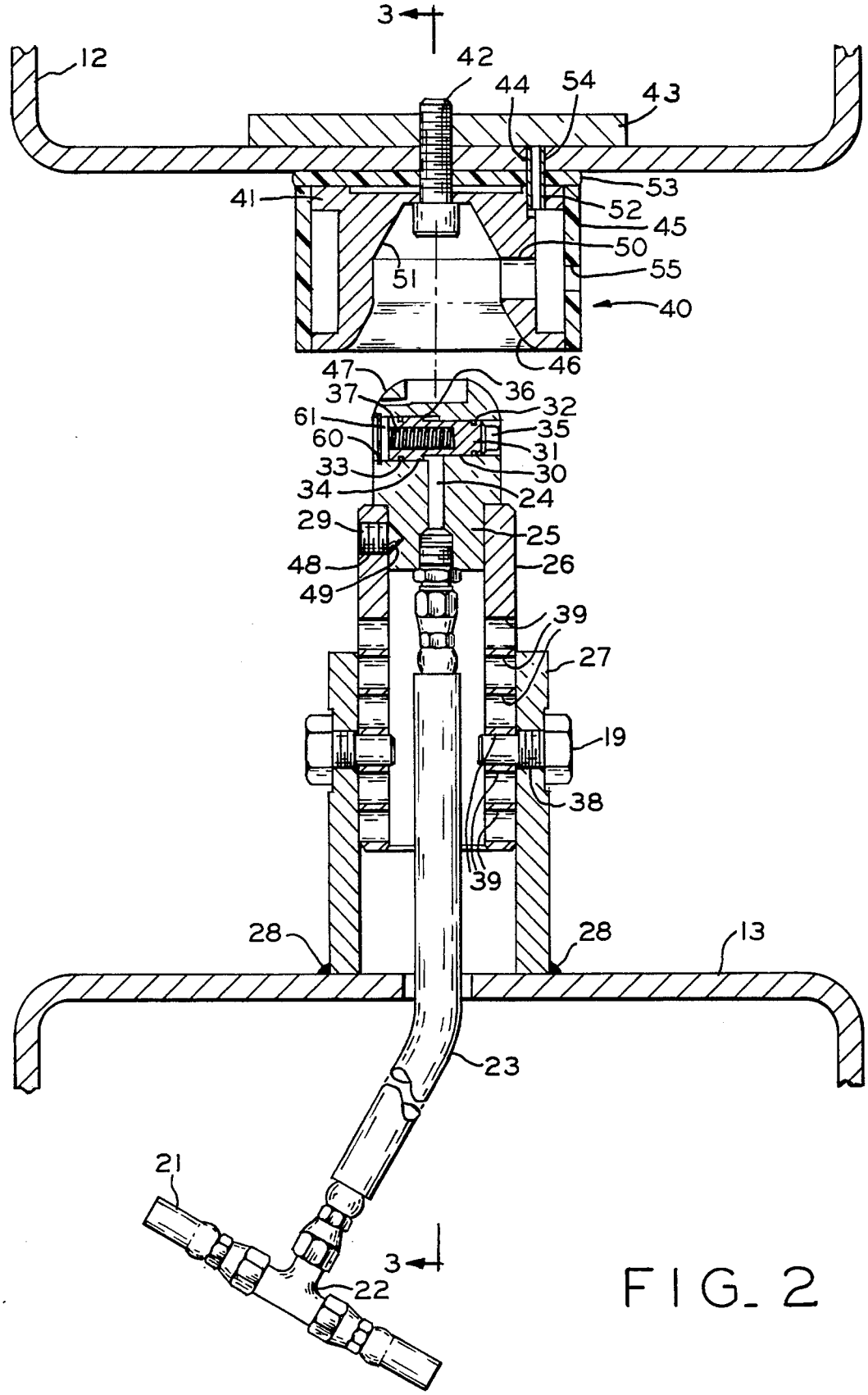
FIG. 2 is a partial section showing a boom latch of the present invention in an unlatched condition.
Figure 3:
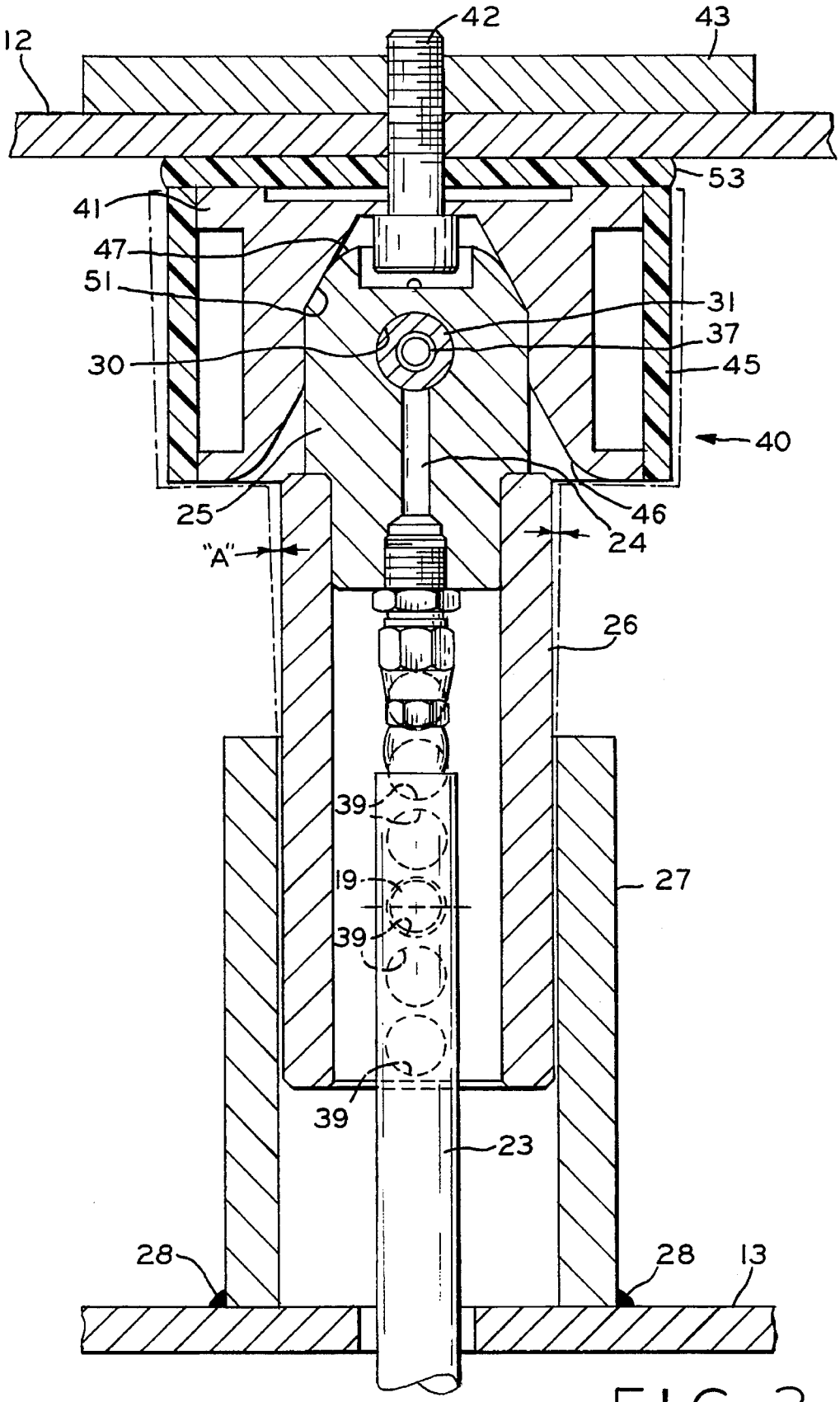
FIG. 3 is a partial section taken along lines 3—3 in FIG. 2 showing a boom latch of the present invention in a latched condition and "phantom" outline of the latch member in pivoted positions.

FIG. 2 is a partial sectional view showing a boom latch of the present invention in an unlatched condition. Boom latch 15 shown is located on lower boom 13 and latches upper boom 12, shown in FIG. 1. Upper boom 12 is raised from lower boom 13, and is therefore in a use position. A power supply means, hydraulic hose 21, passes through lower boom 13, and supplies hydraulic power to cylinder 18. It will be appreciated that when such power is applied to raise upper boom 12, a high hydraulic pressure will exist in hose 21. When upper boom 12 is moved to its stowage position as shown in FIGS. 1 and 3, hydraulic pressure in hose 21 will drop. Through T connector 22, hydraulic pressure is operatively communicated through hose 23 to hydraulic chamber 24 of stainless steel cylindrical latch body 25. Latch body 25 is spaced from lower boom 13 by steel inner nose tube 26 and outer nose tube 27. Outer nose tube 27 is welded to lower boom 13 at 28. Bolts 19 screw into threaded holes 38 in outer nose tube 27 and pass into bored holes 39 in nose tube 26, thereby supporting loads on latch body 25. It will be understood that bores 39 provide sufficient clearance with bolts 19 to allow inner nose tube 26 to pivot about the axis of bolts 19. The cylindrical outer surface of inner nose tube 26 has a reduced diameter relative to the diameter of inner cylindrical surface of outer nose tube 27, thereby providing inner nose tube 26 with clearance to pivot as shown in FIG. 3. Angle "A" in FIG. 3 shows the amount of pivoting. The amount of clearance can be chosen such that the relative movement of latch body 25 due to rotation and the possible pivoting angle "A" is sufficiently small to allow latch body 25 to engage the inner surface 51 of cup 41 when upper boom 12 is brought into the latched position. Threaded hole 48 in upper nose tube 26 and conical surface 49 receive set screw 29, thereby securing latch body 25 in nose tube 26.

Bolts 19 can be threaded into any pair of holes 39 in nose tube 26 having a common axis, thereby providing axial adjustment of the overall length of the latch mechanism for use with different size booms and/or hydraulic cylinders.

Latch body 25 is defined by its exterior surface. Latch body 25 contains a central bore 30 in which latch member 31 may move laterally. In FIG. 2, latch member 31 is shown in its unlatched position in which it resides within latch body 25. Spring 37 is mounted in bore 30 by retaining ring 60 and washer 61 to bias latch member 31 towards its projecting, latched position. Disposed around latch member 31 are O rings 32 and 33, which help seal hydraulic chamber 24.

An important feature of latch member 31 is that its diameter varies so that it is wider at end 34 than at end 35. Annular ridge 36 defines the point where the diameter of latch member 31 changes. The diameter of bore 30 also varies accordingly, and thereby prevents latch member 31 from exiting bore 30.

When it is desired that upper boom 12 be raised from its stowage position, increased hydraulic pressure is applied to hose 21. This increase in pressure will be communicated through hose 23 to hydraulic chamber 24, and the pressure will act on annular ridge 36 to bias and move latch member 31, against the force of spring 37, from its projecting, latched position to the non-projecting, unlatched position shown in FIG. 2. It will be appreciated that an operator need not take any additional action to unlatch upper boom 12; it is automatically unlatched as the hydraulic controls are operated to raise upper boom 12.

In FIG. 2, upper boom 12 is in a raised, use position. Mounted on the lower portion of boom 12 is cylindrical latch receiving means 40. Latch receiving means includes case hardened steel housing cup 41, which is secured to upper boom 12 by socket screw 42 and back plate 43. Elastomeric spacer 53 is located between upper boom 12 and steel housing cup 41. Dowel pin 54 extends through bore 44 in lower portion of boom 12, and bore 52 in housing cup 41, thereby maintaining alignment between latch body 25 and housing cup 41. Cup 41 snugly fits in PVC pipe 45. It will also be appreciated that the interior surface 46 of cup 41 is inwardly tapered toward its upper end, and the upper outer surface 47 of latch body 25 is correspondingly tapered. Thus, when upper boom 12 is lowered toward its stowage position as shown in FIG. 3, tapered interior surface 46 and tapered outer surface 47 will act to properly align upper boom 12 over lower boom 13, and inner nose tube 26 will pivot about bolts 19, thereby allowing the latch to reach its stowed position.

When upper boom 12 is fully lowered as shown in FIG. 3, hydraulic pressure in hose 21 and hydraulic chamber will drop to or near zero. This will cause spring 37 to force latch member 31 outwardly until it projects from latch body 25 to engage the latch member receiving means of cup 41, namely, lip 50. In this position, both lateral and vertical movement of upper boom 12 with respect to lower boom 13 will be restricted, and no additional operator action, other than the lowering of upper boom 12, is required. Moreover, it will be appreciated that the upper surface 47 of latch body 25 will engage the inner surface 51 of cup 41, and thereby allow lower boom 13 to support the weight of upper boom 12 to provide a more secure latched condition.

As described above, when hydraulic pressure is applied to raise upper boom 12, latch member 31 will be moved to the unlatched position shown in FIG. 2. However, in the unlikely event latch member 31 does not move, due for example, to blockage in hydraulic hose 23, upper boom 12 may be manually unlatched. Cup 41 and PVC pipe 45 include a bore 55 at the location adapted to receive latch member 31. A suitable object, such as a screwdriver, may be inserted through bore 55 to manually push latch member 31 against the force of spring 37 until upper boom 12 is unlatched from lower boom 13.

It will be appreciated by those of skill in the art that the present invention provides an inexpensive, easily installable and retrofitable boom latch that self-aligns and provides adjustment for use with various boom and hydraulic cylinder sizes. However, numerous changes could be made to the above implementation without departing from the spirit of the invention. For example, the pivot means could be replaced by a sliding means, thereby allowing alignment between the latch members. Additionally, the hydraulic cylinders and power supply could be replaced by a manual or electrically operated system.

It is also within the scope of the invention to switch the two latching mechanisms shown in the drawings. For example, the nose assembly including the latch member could be placed on upper boom 12, and cup 41 on lower boom 13. In addition, the cup 41 could include a pivot or slide mechanism to allow alignment with the latch member. Cup 41 could also be provided with an axial adjustment mechanism for use with various size booms and/or hydraulic cylinders.

What is claimed is:

1. A latch system for a boom movable between a use position and a stowage position, said latch system comprising:

a latch receiving means; and a latch comprising a latch body, an inner nose tube, an outer nose tube, and a latch member, said latch body movable relative to said latch receiving means, whereby alignment of said latch body with said latch receiving means is enabled, said latch member disposed within said latch body and movable between an unlatched position and a latched position, said latch member engageable with said latch receiving means, said inner nose tube including a plurality of apertures along its longitudinal axis, said inner nose tube being connected to said outer nose tube by at least one fastener, said fastener being connected to said outer nose tube and passing through at least one of said apertures, said inner nose tube pivotable about said at least one fastener and axially adjustable relative to said outer nose tube by selection of a particular aperture to which said at least one fastener is connected.

2. The latch system of claim 1, further comprising a power supply means for moving said boom.

3. The latch system of claim 2, wherein said latch member is operably connected to said power supply means toy move said latch member between said unlatched and said latched positions such that said boom may be latched in said stowage position.

4. The latch system of claim 3 wherein said power supply means is hydraulic.

5. The latch system of claim 4 wherein said latch body includes a hydraulic chamber, and wherein said chamber has a greater volume when said latch member is in said unlatched position.

6. The latch system of claim 5 wherein a diameter of said latch member varies in an axial direction of said latch member such that said latch member is moved toward said unlatched position upon an increase in hydraulic pressure in said hydraulic chamber.

7. The latch system of claim 3 further comprising solenoid means for moving said latch member.

8. The latch system of claim 3 further comprising bias means for biasing said latch member against the direction of movement of said latch member upon an increase of power in said power supply means.

9. The latch system of claim 1 wherein said latch member projects further from said latch body in said latched position, than in said unlatched position.

10. The latch system of claim 1 wherein said latch body includes means for supporting the weight of said boom.

11. The latch system of claim 1 wherein said boom latch receiving means comprises a housing adapted to receive a portion of said latch body and said latch member, said housing having a lip adapted to engage said latch member thereby latching said boom to said latch body.

12. A latch system for a boom movable between a use position and a stowage position, said boom latching to an adjacent surface in said stowage position, said latch system comprising:

a latch comprising a latch body, an inner nose tube, an outer nose tube, and a latch member, said latch member disposed within said latch body and movable between an unlatched position and a latched position, said latch body fixedly attached to said inner nose tube, said inner nose tube pivotally connected to and axially adjustable relative to said outer nose tube, said outer nose tube fixedly connected to one of said boom and said adjacent surface, said inner nose tube including a plurality of apertures along its longitudinal axis, said inner nose tube being connected to said outer nose tube by at least one fastener, said at least one fastener being connected to said outer nose tube and passing through at least one of said apertures, said inner nose tube pivotable about said at least one fastener, said inner nose tube being axially adjustable relative to said outer nose tube by selection of a particular aperture to which said at least one fastener is connected; and a latch member receiving means comprising a housing adapted to receive a portion of said latch body and said latch member, said latch member receiving means fixedly connected to the other of said boom and said adjacent surface, said housing having a lip adapted to engage said latch member, said latch member engageable with said latch member receiving means in said latched position for securing said boom to said latch body, said latch member projecting further from said latch body in said latched position then in said unlatched position, said latch body movable relative to said latch member receiving means whereby said latch is enabled to align with said latch member receiving means.

13. The latch system of claim 12, further comprising a power supply means for moving said boom.

14. The latch system of claim 13, wherein said latch member is operably connected to said power supply means to move said latch member between said unlatched and said latched position such that said boom may be latched in said stowage position.

15. A boom latch system for securing a boom to itself and to a motor vehicle, said boom latch system comprising:

a boom movable between a use position and a stowage position;

a hydraulic power supply means for moving said boom;

a latch comprising a latch member, a latch body, an inner nose tube, and an outer nose tube, said latch member disposed within said latch body and movable between an unlatched position and a latched position, said inner nose tube including a plurality of apertures along its longitudinal axis, said inner nose tube being connected to said outer nose tube by at least one fastener, said fastener being connected to said outer nose tube and passing through at least one of said apertures, said inner nose tube pivotable about said at least one fastener and axially adjustable relative to said outer nose tube by selection of a particular aperture to which said at least one fastener is connected;

a latch member receiving means comprising a housing adapted to receive a portion of said latch body and said latch member, said housing having a lip adapted to engage said latch member for latching said boom to said latch body, said latch member engageable with said latch member receiving means in said latched position for securing said boom to said latch body, said latch member projecting further from said latch body in said latched position than in said unlatched position, said latch body pivotable relative to said latch member receiving means whereby said latch member aligns with and moves relative to said latch member receiving means during transport of said motor vehicle to accommodate for stresses acting on said system resulting from said transport;

and bias means for biasing said latch member against the direction of movement of said latch member upon an increase in hydraulic pressure.

16. The boom latch system of claim 15 wherein said latch body includes a hydraulic chamber, and wherein said chamber has a greater volume when said latch member is in said unlatched position.

* * * * *